United States Patent [19]

Meywald et al.

[11] 4,313,049

[45] Jan. 26, 1982

[54] ELECTRICAL HEATING ELEMENT FOR FLUID MEDIA

[75] Inventors: Klaus Meywald; Helmut Ohnmacht, both of Kandel, Fed. Rep. of Germany

[73] Assignee: Firma Fritz Eichenauer, Kandel, Fed. Rep. of Germany

[21] Appl. No.: 91,376

[22] Filed: Nov. 5, 1979

[51] Int. Cl.[3] ..... H05B 1/00

[52] U.S. Cl. ..... 219/375; 338/305; 338/318

[58] Field of Search ..... 219/364, 368–370, 219/374–376, 380–382, 542; 338/296–300, 302, 304, 305, 253, 315, 317, 318, 319; 336/205, 234

[56] References Cited

U.S. PATENT DOCUMENTS

| | | | |
|---|---|---|---|
| 1,507,901 | 9/1924 | Wells | 338/253 |
| 1,860,301 | 5/1932 | Thomas | 338/253 |
| 2,078,778 | 4/1937 | Shepard | 338/305 |
| 2,280,977 | 4/1942 | Reichmann | 338/234 |
| 4,163,146 | 7/1979 | Meywald | 219/542 |

FOREIGN PATENT DOCUMENTS

| | | | |
|---|---|---|---|
| 2264451 | 10/1975 | France | 219/375 |

*Primary Examiner*—Arthur T. Grimley
*Assistant Examiner*—Bernard Roskoski
*Attorney, Agent, or Firm*—Craig and Antonelli

[57] ABSTRACT

A heating element (for a hair dryer, fan heater or other electrical appliance) in which the turns of resistance heating wire are held in place, in edge recesses of support plate means, by a strip of heat-resistant cement applied to the supporting edges and over the turns of the wire. The cement is non-wetting with respect to the heating wire.

4 Claims, 6 Drawing Figures

ELECTRICAL HEATING ELEMENT FOR FLUID MEDIA

The invention relates to an electrical heating element for fluid and more particularly gaseous media, comprising a support plate (or support means) of insulating material and a heating conductor of resistance wire surrounding the support plate, the heating conductor being wound as a coil and supported on supporting edges of the support plate.

Many constructional forms of heating elements arranged in this way are known, and are used in apparatus of all sizes for the heating of, more particularly, air. The invention is concerned basically with heating elements of all size ranges, but with particular advantage in those which are employed in relatively small electrical hot air appliances such as hair dryers, fan heaters and so on. Usually, though not necessarily, the medium to be heated is taken past the heating element by a fan or blower or the like.

Depending on the power consumption, intended temperature and so forth, the resistance wire can be of round or rectangular cross-section, can in itself be plain or wound helically or in meander loops, and is in any case wound in the form of a coil about the support plate. The coil is supported on supporting edges, or, to put it more precisely, on narrow sides of the support plate. The support plate may be a plane plate with two oppositely situated supporting edges, but it may also have a plurality of supporting edges, for example with a cross-shaped cross-section comprising two plates fitted into one another by means of suitable slots.

In known heating elements of the category specified the problem exists that, because of temperature-change stresses caused in operation, the heating conductor turns may become loosened following thermal expansion and become displaced on the supporting edges, so that it is no longer guaranteed that the intended inter-turn spacings will be maintained during operation. Consequently inter-turn short-circuiting may occur, which is undesirable and in some cases may result in destruction of the heating element. The same applies correspondingly to heating elements of the category specified wherein the heating conductor is in itself arranged in sinuous coils or loops. This risk exists even when the heating conductor turns are secured in edge recesses of the supporting plate. Even in such cases, thermal expansion may result in the heating conductor turns becoming displaced from the edge recesses and coming into contact with neighbouring turns. Giving the edge recesses such a depth that such turn displacements are reliably obviated causes considerable manufacturing difficulties and therefore can be disregarded in actual practice.

The invention has as its object to provide an electrical heating element of the category initially herein specified which can be produced in a simple and unproblematic manner as regards manufacturing tehcniques and wherein the heating conductor turns may be reliably secured in well-defined positions under all circumstances.

According to the invention this object is achieved in that the support means is provided with an applied layer of heat-resistant cement which overlies the heating conductor turns in the region of the supporting edges. The invention makes use of the fact that the cement enters into an adhesive bond with the support plate, which may consist of synthetic mica for example, such bond having adequate resistance to the operating temperature of the heating element. Such cements are known to persons skilled in the art. This cement layer proposed by the invention, and extending preferably over the entire length of the supporting edges, forms a kind of bar which fixes the heating conductor turns in well-defined positions on the supporting edges.

The heating conductor turns can be embedded in the cement layer in the region of the supporting edges to a more or less considerable extent. However, this gives increased heat transfer into the support plate, and this is usually not desirable. At the same time the cement layer reduces the radiation of heat from the heating conductor in the region of the supporting edges. Because of these factors, a construction form is preferred wherein the width of the applied cement layer (measured in a direction at right angles to the plane of the support plate) is so dimensioned that the cement layer is restricted substantially to the narrow sides or edges of the support plate, plus the directly adjoining regions of the broad sides or surfaces if appropriate, but does not extend to any extent worth mentioning over the broad sides of the supporting plate. The optimum from the thermal point of view is a constructional form wherein the width of the cement layer corresponds substantially to the thickness of the support plate. Where this causes difficulties regarding manufacture and strength aspects, it is recommended to use a constructional form wherein the width of the applied cement layer corresponds substantially to the width of the heating conductor portion extending over the supporting edge, that is to say a meander loop portion for example. In every case it is possible to ensure that the heating conductor is covered by the cement only in the region of the supporting edges, and heat can be radiated unhindered over the greatest possible extent of its length.

According to a further teaching of the invention the securing of the heating conductor turns can be further improved if the heating conductor—in a manner known per se—is secured in edge recesses of the supporting plates, and the cement layer extends at the most as far as the bottom of the edge recesses. Thus, with the least possible disturbance to heat dissipation, the heating conductor turns are reliably secured and it is particularly advantageous that the edge recesses can be given an extremely shallow depth. This is a great advantage with regard to the production and winding of the support plates, and a further result is to reduce the risk of the webs or intervening portions between edge recesses suffering breakage.

With a view to winding the heating conductor on the supporting plate easily, edge recesses with a relatively wide-open triangular shape are preferable. So that the turns cannot escape from the edge recesses in this case it would be necessary normally to make the webs between the edge recesses correspondingly high and thus to make the turn spacings correspondingly large, which is undesirable when it is intended to have a small overall construction and a high power density. In this context the cement layer provided in accordance with the invention affords the advantageous possibility of using edge recesses of shallow depth and yet ensuring that the heating conductor turns are secured in the desired positions. Since the applied cement layer extends at the most as far as the bottom of the edge recesses, the covering of the heating conductor by the cement layer is limited to the immediate region of the supporting edges.

Preferably, however, the cement layer is made substantially less extensive in depth, so that it extends considerably less deep than the bottom of the edge recesses. In the usual constructional arrangement, wherein the webs between the edge recesses project beyond the outer side of the heating conductor, it is desirable for the cement layer nowhere to extend substantially any further than the outside of the heating conductor turns, in order that heat can be given off to the optimum extent. In this connection a constructional form is particularly advantageous wherein the cement layer does not even extend substantially beyond the contour of the support plate into the edge recesses. Thus the cement layer forms, in the region of the edge recesses, as it were bridges which have no or at the most a negligible physical contact with the heating conductor and thus have the least possible prejudicial effect on the dissipation of heat. These measures are assisted if a cement is used which does not wet the material of the heating conductor.

The application of the cement layer proposed by the invention can be effected by hand with little labour and in a simple manner. It is also possible with advantage, where large-series manufacture is concerned, to apply the cement by means of a slit nozzle the length of which corresponds to the length of the respective supporting edges and the width is adjusted to the intended width of the applied cement layer.

The invention will be explained in detail hereinafter with reference to the accompanying drawings which show just constructional examples. In these drawings.

Figure 1:
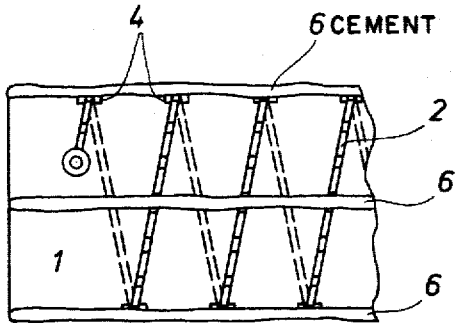
FIG. 1 shows a side view of an electrical heating element.
Figure 2:
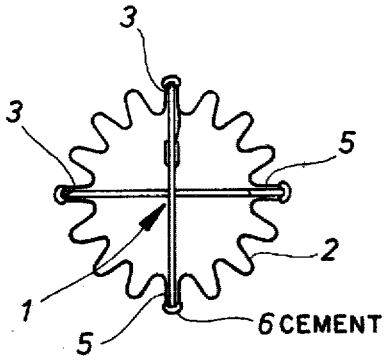
FIG. 2 shows the subject of FIG. 1 in end view.

The electrical heating element shown in FIGS. 1 and 2 comprises basically a support plate (or support means) 1 of insulating material, of cross-shaped cross-section, and a heating conductor 2 of resistance wire. The heating conductor 2 is wound in the form of a coil (specifically a helical coil) about the support plate 1, coiled sinuously or in meander fashion in itself (cf. FIG. 2) and is supported on the narrow sides of the support plate 1, which are referred to here as supporting edges 3. In the illustrated constructional example the support plate 1 is provided at the supporting edges 3 with edge recesses 4 in the region of each of which a meander loop 5 of the heating conductor engages over the support plate 1.

As the drawings show clearly, the support plate 1 is provided with applied layers 6 each in the form of a relatively narrow strip of cement, overlying the turns of the heating conductor 2 in the region of the supporting edges 3. The cement consists of a per-se known suitable material of suitable heat resistance, which enters into an adhesive bond with the material of the support plate 1 and fixes the turns of the heating conductor 2 on the supporting edges 3. The cement layers 6 extend over the entire length of the supporting edges 3.

FIGS. 3 to 6 show further details. The cross-section views in FIGS. 4 and 6 respectively show that the cement layer 6 is limited substantially to the region of the supporting edges 3 and does not extend to any considerable extent to the wide sides of the supporting plate 1. As a result, the heating conductor 2 is covered by cement only in the region of the supporting edges 3 and the giving-off of heat is otherwise not hindered.

Figure 3:
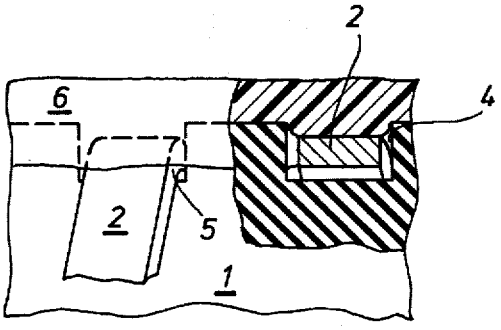
FIG. 3 shows a fragmentary view of the subject of FIG. 1 on a larger scale.
Figure 4:
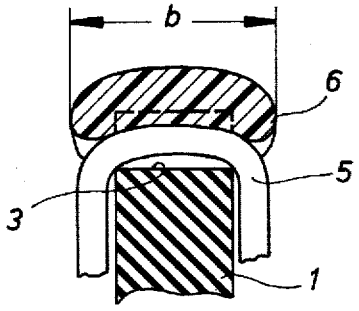
FIG. 4 shows the subject of FIG. 3 in cross-section on IV—IV.

In the constructional example shown in FIGS. 3 and 4 the heating conductor 2 is rectangular in cross-section and is secured in rectangular recesses 4 in the edges of the support plate 1, this being shown with the help of the part-section view in FIG. 3. The edge recesses 4 are of relatively slight depth, corresponding substantially to the cross-section height of the heating conductor 2. Secure fixing of the heating conductor 2 under all circumstances is achieved by the cement layer 6 the width b of which corresponds substantially to the width of the meander loop 5 engaging over the support plate 1 (cf. FIG. 4). In the direction of depth i.e. in the direction of the plane of the support plate, the applied cement layer 6 extends not quite as far as the bottom of the edge recesses 4 (cf. FIGS. 1 and 3).

Figure 5:
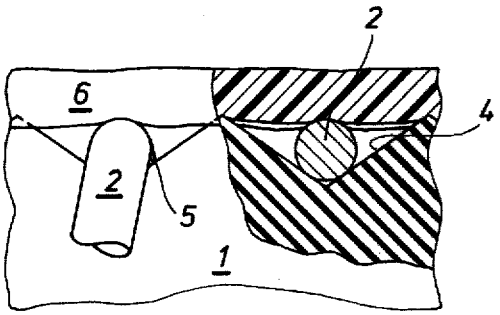
FIG. 5 shows another constructional form of the subject of FIG. 3.
Figure 6:
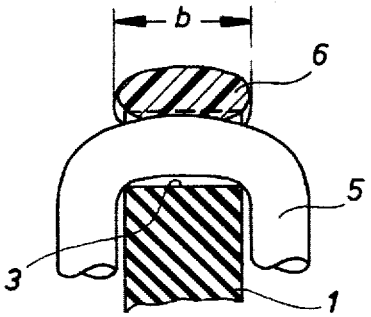
FIG. 6 shows the subject of FIG. 5 in cross-section on VI—VI.

In the constructional example shown in FIGS. 5 and 6 the heating conductor 2 is of circular cross-section and the support plate 1 is provided with triangular edge recesses 4. The cement layer 6, the width b of which corresponds only to substantially the thickness of the support plate 1 (cf. FIG. 6), extends in the direction of the depth of the support plate 1 substantially only as far as the outside of the turns of the heating conductor 2.

There is the possibility (not shown in the drawings) of still further reducing the extent of the applied cement layer 6 in the direction of width, so that it does not extend substantially beyond the contour of the support plate 1 into the edge recesses 4. In such a constructional form, with which it is also readily possible to achieve an adequately reliable securing of the heating conductor 2, the region of the connection between the supporting plate 1 and the applied cement layer 6 is restricted practically to only the narrow sides of the supporting plate 1, so that the applied cement layer 6 forms bridges over the edge recesses 4.

What is claimed is:

1. Electrical heating element for fluid and more particularly gaseous media, comprising a support plate means of insulating material having supporting edges with recesses formed therein, a resistance heating wire wound about the support means in a manner so as to be supported within the recesses and a layer of heat-resistant cement that is non-wetting with respect to the material of said heating wire applied to said support means so as only to overlie the resistance wire in a region of said edges and so as to extend into said recesses at most to a minor extent, whereby said cement forms, in the vicinity of the recesses, bridges having minimal physical contact with said resistance wire and prejudicial affects on heat dissipation are minimized.

2. Heating element according to claim 1, wherein the width of the applied cement layer corresponds substantially to the thickness of the support plate means.

3. Heating element according to claim 1, wherein the width of the applied cement layer corresponds substantially to the length of heating wire portions engaging over a respective one of the supporting edges.

4. Heating element according to claim 1, wherein the applied cement layer does not extend beyond the heating wire into the edge recesses.

* * * * *